United States Patent [19]

Sakuma

[11] Patent Number: 4,926,635

[45] Date of Patent: May 22, 1990

[54] EXHAUST SYSTEM FOR MULTI-CYLINDER ENGINE

[75] Inventor: Yuichi Sakuma, Yokosuka, Japan

[73] Assignee: Nissan Motor Co., Ltd., Yokohama, Japan

[21] Appl. No.: 202,000

[22] Filed: Jun. 3, 1988

[30] Foreign Application Priority Data

Jun. 8, 1987 [JP] Japan ..... 62-143863

[51] Int. Cl.[5] ..... F01N 3/28; F02B 27/02

[52] U.S. Cl. ..... 60/299; 60/313; 60/323; 181/236; 181/240

[58] Field of Search ..... 60/299, 323, 313; 181/240, 236

[56] References Cited

U.S. PATENT DOCUMENTS 3,072,214 1/1963 Deremer ..... 60/313
4,154,058 5/1979 Mase ..... 60/313

FOREIGN PATENT DOCUMENTS 2613607 10/1976 Fed. Rep. of Germany ..... 60/299
178820 10/1983 Japan ..... 60/323
1025906 6/1983 U.S.S.R. ..... 60/313

*Primary Examiner*—Douglas Hart
*Attorney, Agent, or Firm*—Pennie & Edmonds

[57] ABSTRACT

An exhaust system for a V-type six-cylinder engine having first and second banks each having three engine cylinders. The exhaust system includes first and second exhaust systems which are respectively connected to the first and second banks to be supplied with exhaust gas from the engine cylinders. Each exhaust system includes an exhaust tube connecting a catalytic converter and a muffler. The exhaust tubes of the first and second exhaust systems are communicated at a predetermined position by a communicating pipe member. The predetermined position corresponds to location of antinodes of the resonance sound pressure modes in the respective first and second exhaust systems which modes are reverse in phase to each other, so that resonance frequencies in exhaust noise are cancelled thereby to effectively achieve exhaust noise reduction.

10 Claims, 8 Drawing Sheets

EXHAUST SYSTEM FOR MULTI-CYLINDER ENGINE

BACKGROUND OF THE INVENTION

1. Field of the Invention

This invention relates to improvements in an exhaust system of a multi-cylinder internal combustion engine of which said exhaust system includes parallely arranged two exhaust systems respectively for two groups of engine cylinders, and more particularly to such an exhaust system in which exhaust tubes of the first and second exhaust systems communicate with each other for the purpose of attaining noise reduction.

2. Description of the Prior Art

In general, exhaust gas of an internal combustion engine is discharged into ambient air through an exhaust system including a catalytic converter for converting harmful components of the exhaust gas into harmless components and a muffler for reducing exhaust noise. In this connection, it is well known that the exhaust system contributes to increased back pressure of exhaust gas thereby inviting loss in engine power output. Particularly in an engine having a large displacement, such engine power loss due to exhaust back pressure is conspicuous, and therefore the exhaust system is divided into a plurality of exhaust systems so that exhaust gas flow rate in each exhaust system is reduced thereby to suppress an increase in back pressure and to reduce engine power loss.

However, with such an exhaust system, since the respective exhaust systems are acoustically completely independent from each other, exhaust noise unavoidably increases though engine power loss reduces. Additionally, this exhaust noise is usually uncomfortable in a auditory sense thereby deteriorating ride-on comfortableness.

SUMMARY OF THE INVENTION

It is an object of the present invention to provide an improved exhaust system which can lower exhaust noise level without increasing engine power loss, cancelling frequency components which are uncomfortable in an auditory sense.

Another object of the present invention is to provide an improved exhaust system including two exhaust systems, in which communication is established between the two exhaust systems whose sound pressure modes are reverse in phase to each other.

An exhaust system for a multi-cylinder engine, according to the present invention is comprised of first and second exhaust systems each of which includes a muffler and an exhaust tube fluidly connected to the muffler. The exhaust tube of the first exhaust system communicates with the first group of exhaust ports of the engine, while the exhaust tube of the second exhaust system communicates with the second group of exhaust ports of the engine. The exhaust tubes of the first and second exhaust systems communicate with each other at a predetermined position of the exhaust tubes.

Thus, according to the present invention, the exhaust tubes of the first and second exhaust systems communicate with each other at the predetermined position corresponding to the position of the antinodes of resonant sound pressure modes of the respective exhaust systems on the basis of the fact that the sound pressure modes of the respective exhaust systems are reverse in phase to each other. Accordingly, the antinodes of the reverse phase sound pressure modes are composed and cancelled with each other, thus omitting resonant frequencies in the exhaust systems. This cancels frequency components which are uncomfortable in an auditory sense, thereby lowering exhaust noise level without increasing engine power loss due to exhaust back pressure.

BRIEF DESCRIPTION OF THE DRAWINGS

In the drawings, like reference numerals or characters designate corresponding parts and elements throughout all figures, in which.

DETAILED DESCRIPTION OF THE INVENTION

Figure 1:
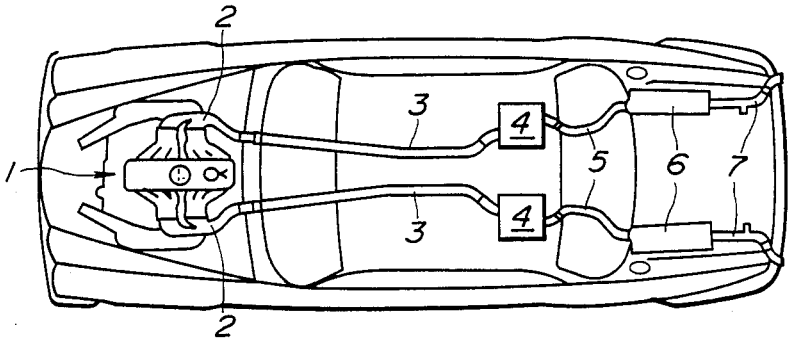
FIG. 1 (PRIOR ART)
FIG. 1 is a schematic illustrative view of an automotive vehicle equipped with a conventional exhaust system.

To facilitate understanding of the present invention, a brief reference will be made to a conventional exhaust system of a multi-cylinder engine, depicted in FIG. 1. Referring to FIG. 1, a V-type six-cylinder engine 1 is provided with an exhaust system which includes two exhaust systems through which exhaust gas of the engine 1 is discharged to ambient air. In each exhaust system, exhaust gas from respective engine cylinders is gathered in an exhaust manifold 2 and discharged through a tube 3, a center muffler 4, a tube 5, a rear muffler 6 and a tail tube 7, reducing exhaust noise.

However, difficulties have been encountered in such a conventional exhaust system of the multi-cylinder engine, in which the exhaust systems are acoustically completely independent from each other and therefore generate high exhaust noise though providing the advantage of decreasing loss in engine power output. More specifically, in the case of the above-mentioned V-type six-cylinder engine, one exhaust system generates exhaust noise having a frequency component of 3n times (n=0, 1, 2, . . . ) the engine speed N (engine revolution speed per second), while the other exhaust system generates exhaust noise having a frequency component of 1.5+3n times (n=0, 1, 2, . . . ) the engine speed N, this frequency component being referred hereinafter to as "(1.5+3n)nd harmonics". Accordingly, the region occupied with the above-mentioned frequency components is widened thereby unavoidably raising noise level. Additionally, such exhaust noise frequency components are very uncomfortable in an auditory sense thereby deteriorating ride-on comfortableness. This is because the difference between the frequency components of exhaust noise approaches a value of ½of the width of the critical region in a normal engine speed range.

Otherwise, an exhaust system in which a plurality of exhaust systems are communicated with each other has been proposed for a multi-cylinder engine and disclosed in Japanese Utility Model Provisional Publication No. 61-5316. However, this exhaust system has been proposed upon paying attention to decreasing loss of engine power output and therefore is not intended to lower exhaust noise, thus never solving acoustic problems encountered in the conventional exhaust system of FIG. 1.

Figure 2:
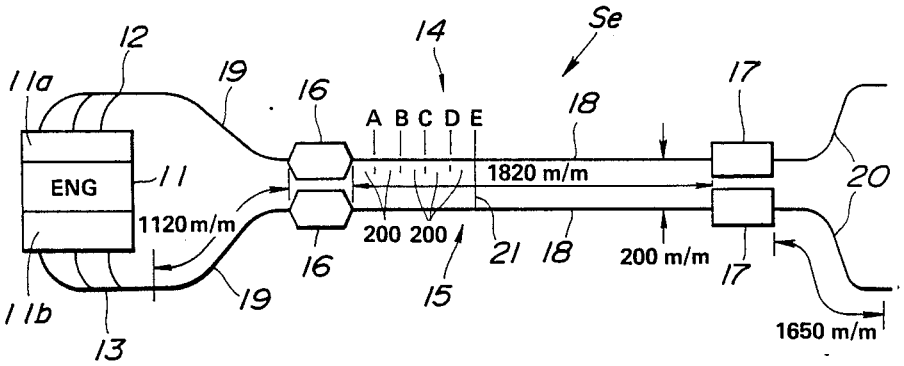
FIG. 2 is a diagrammatic view of a first embodiment of an exhaust system according to the present invention.

In view of the above description of the conventional exhaust system of the multi-cylinder engine, reference is now made to FIGS. 2 to 9, and more specifically to FIG. 2, wherein a first embodiment of an exhaust system of the present invention is illustrated by the reference character Se. The exhaust system Se is provided for a V-type six-cylinder internal combustion engine 11 for an automotive vehicle and consists of first and second exhaust systems 14, 15. The first exhaust system 14 is connected to an exhaust manifold 12 connected to a first bank 11*a* of the engine 11. The second exhaust system 15 is connected to an exhaust manifold 13 connected to a second bank 11*b* of the engine 11. The exhaust manifold 12 having three manifold branches each of which communicates with each exhaust port of the first bank 11*a*. Similarly, the exhaust manifold 13 has three manifold branches each of which is connected to each exhaust port of the second bank 11*b*. Accordingly, exhaust gas from the first bank 11*a* is gathered by the exhaust manifold 12 and discharged to ambient air through the first exhaust system 14. Similarly, exhaust gas from the second bank 11*b* is gathered by the exhaust manifold 13 and discharged to ambient air through the second exhaust system 15. As shown, the first and second exhaust systems 14, 15 are disposed generally symmetrical with each other relative to the extension of an axis (not identified) of the engine 11. Discussion will be made hereinafter of one of the two exhaust systems 14, 15 since the two exhaust systems are the same in structure and function as each other.

The exhaust system 15 includes a catalytic converter 16 and a muffler 17 which are coaxially connected to each other by a tube 18 formed of a straight pipe. The catalytic converter 16 contains therein a catalyst to convert harmful components in exhaust gas into harmless ones. The catalytic converter 16 is connected to the tube 19 so that exhaust gas from the exhaust manifold 13 is introduced into the catalytic converter 16. The muffler 17 is of the simple expansion type wherein the cross-sectional area of passage of exhaust gas is simply expanded thereby to abruptly lower the pressure of exhaust gas so as to reduce exhaust noise. A tube 20 is connected to the muffler 17 so that exhaust gas from the muffler 17 is discharged therethrough to ambient air. Accordingly, exhaust gas from the exhaust manifold 13 passes through the tube 19, the catalytic converter 16, tube 18, the muffler 17 and the tube 20 to be discharged out of the exhaust system 15 and to ambient air. The dimensions of component parts of the exhaust systems 14, 15 in this embodiment are set as follows: The inner diameter of each tube 18, 19, 20 is 47.6 mm; the thickness of each tube 18, 19, 20 is 1.6 mm; and the lengths of the tube 18, 19 and 20 are respectively 1820 mm, 1120 mm, 1650 mm. Additionally, the tubes 18, 18 of the first and second exhaust systems 14, 15 are disposed parallel and separate from each other by a distance of 200 mm. The tubes 20, 20 of the first and second exhaust systems 14, 15 are curved outwardly and located symmetrical in such a manner that their open ends are separate by a distance of 1500 mm. The catalytic converter 16 has an inner diameter of 120 mm and a length of 350 mm. Additionally, the tubes 18, 18 of the first and second exhaust systems 14, 15 are communicated with each other by means of a communicating pipe member 21 at a position indicated by the reference character A, B, C, D, or E. This position is referred to hereinafter as a "connecting position". More specifically, the communicating pipe member 21 has one end connected to the tube 18 of the exhaust system 14 at the position E. The other end of the communicating pipe member 21 is connected to the tube 18 of the exhaust system 15 at the position E. Although the connecting position is shown at the position E, setting of the connecting position will be made in accordance with simulation calculation as discussed hereinafter.

Next, the manner of operation of the exhaust system Se will be discussed hereinafter. First, the fundamental principle of the present invention will be explained.

As a technique for calculating sound attenuation characteristics of an exhaust system, there is one called four-terminal constants method by which sound attenuation amount and sound pressure mode of a pipe line system are obtained. Now, when sound wave propagates through a pipe line such as of the exhaust system, the relationships represented by the following Eqs. (1) and (2) are established on the assumption that sound pressures at inlet and outlet of the pipe line are respectively $P_1$ and $P_2$; and the volume velocities at the inlet and outlet are respectively $U_1$ and $U_2$.

$$P_1 = A \cdot P_2 + BU_2 \quad (1)$$

$$U_1 = CP_2 + DU_2 \quad (2)$$

where A, B, C and D are constants, respectively. The constants A, B, C and D are called four terminal constants. Eqs. (1) and (2) are represented by a determinant to obtain Eq. (3) which is well known.

$$\begin{pmatrix} P_1 \\ U_1 \end{pmatrix} = \begin{pmatrix} A & B \\ C & D \end{pmatrix} \begin{pmatrix} P_2 \\ U_2 \end{pmatrix} \quad (3)$$

The four-terminal constants are represented respectively by Eqs. (4), (5), (6) and (7):

$$A = \cos kl \quad (4)$$

$$B = j\frac{\rho C}{S}\sin kl \quad (5)$$

$$C = j\frac{S}{\rho C}\sin kl \quad (6)$$

$$D = \cos kl \quad (7)$$

where $\rho$ is the density (kg/m$^3$) of exhaust gas; C is the sound velocity (m/sec) within a pipe line;

$$k\left(=\frac{2\pi f}{C}\right)$$

is the wave length constant (1/m); f is the frequency of sound wave; j is $\sqrt{-1}$; and S is the cross-sectional area of the pipe. Accordingly, the four-terminal constants vary depending on frequency of sound wave even with the same pipe line.

The four-terminal constants A, B, C and D are values for a simple pipe line. In this connection, for an actual complicated exhaust system, the four-terminal constants can be obtained by considering that the exhaust system is an aggregate of a plurality of simple elements. For example, on the assumption that a pipe line is divided from the side of inlet into three parts X, Y and Z whose four-terminal constants are expressed by attaching suffixes X, Y and Z, the four-terminal constants of the whole pipe line is given by Eq. (8).

$$\begin{pmatrix} P_1 \\ U_1 \end{pmatrix} = \begin{pmatrix} A_X & B_X \\ C_X & D_X \end{pmatrix}\begin{pmatrix} A_Y & B_Y \\ C_Y & D_Y \end{pmatrix}\begin{pmatrix} A_Z & B_Z \\ C_Z & D_Z \end{pmatrix}\begin{pmatrix} P_2 \\ U_2 \end{pmatrix} = \begin{pmatrix} A & B \\ C & D \end{pmatrix}\begin{pmatrix} P_2 \\ U_2 \end{pmatrix} \quad (8)$$

Accordingly, the four-terminal constants of a pipe line which is divided into four or more parts can also be calculated similarly in the order of elements from the inlet side.

Calculation of sound attenuation amount (noise reduction amount) using the thus obtained four-terminal constants will be carried out as follows:

1. Sound attenuation amount

The sound attenuation amount is called "insertion loss level" (referred hereinafter to as "IL") which corresponds to an attenuation amount (represented by decibel, dB) in sound pressure level, produced between input and output of sound and given by Eq. (9).

$$IL = 20 \log D \quad (9)$$

Figure 3:
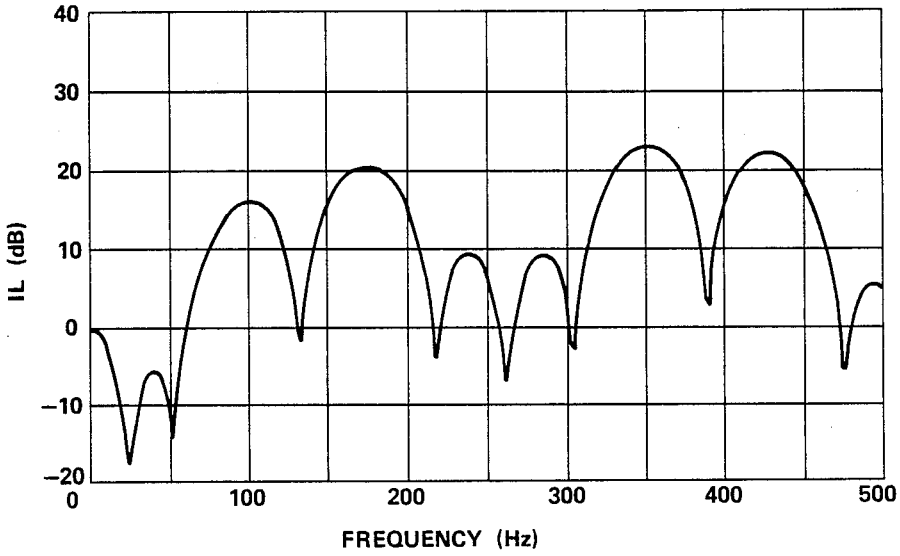
FIG. 3 is a graph of an example of noise reduction characteristics.

Calculation for a certain frequency is made according to Eq. (9) and charted thereby to obtain a noise reduction characteristics diagram, for example, as shown in FIG. 3. In FIG. 3 where the sound attenuation amount is indicated as a positive value, outlet sound pressure is higher in level than inlet sound pressure at a frequency at which IL takes a negative value. This is caused by resonance within the pipe line thereby increasing exhaust noise from the engine at the above-mentioned frequency which is referred hereinafter as a "resonant frequency". Additionally, it is considered that such resonance is also developed at the frequency at which IL abruptly lowers to form a through section even without a negative value of IL. It is known that actually measured values and calculated values of IL are well coincident with each other at the frequencies below about 500 Hz of the noise reduction characteristics diagram.

2. Sound pressure mode in pipe line (exhaust) system

The sound pressure mode corresponds to a sound pressure variation determined relative to a position in the pipe line. For example, if a frequency at which IL is the minimum is determined by Eq. (9) on the assumption that the four-terminal constants at a predetermined position X in the exhaust system is a matrix $|M|_x$, the sound pressure $P_x$ and the volume velocity $U_x$ at the predetermined position x in the exhaust system are given by Eq. (10) upon using an inverse matrix $|M|_x^{-1}$.

$$\begin{pmatrix} P_x \\ U_x \end{pmatrix} = |M|_x^{-1} \cdot \begin{pmatrix} P_1 \\ U_1 \end{pmatrix} \quad (10)$$

Figure 4:
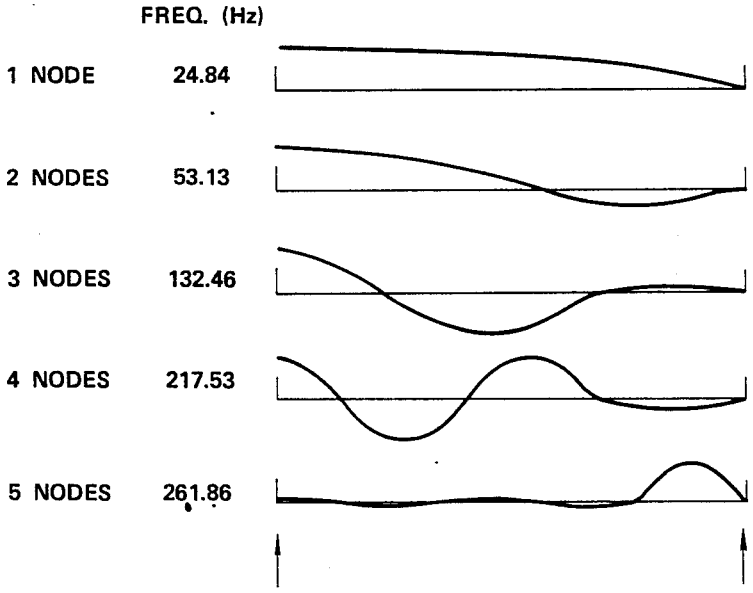
FIG. 4 is a graph of an example of sound pressure mode.

From the above, a ratio between a sound pressure $P_1$ at an inlet and a sound pressure $P_x$ at the predetermined position is obtained by successively changing the value of x with respect to positions from the inlet to the outlet. These ratios are charted as sound pressure variation relative to distance, thereby obtaining sound pressure mode diagrams as shown, for example, in FIG. 4. In other words, the graphs of FIG. 4 show the fact that resonance is caused at a plurality of frequencies (one to five resonant frequencies in the case of FIG. 4), the axis of abscissa of the graph indicating the position in the pipe line. In the case where the analyzed result of the thus obtained noise reduction characteristics and sound pressure modes are employed for improvement of noise reduction characteristics of an actual exhaust system, it is in general difficult to obtain a target noise reduction characteristics by only one simulation, and therefore such a simulation is repeatedly carried out upon changing the dimensions, shape and the like of the exhaust system depending on previous simulation results, until the target noise reduction characteristics are obtained.

The above-discussed is a summary of the four-terminal constants method now used mainly for determining the dimensions and the location of a muffler. In connection with this embodiment, the four-terminal constants method is used for determining the position of the communicating pipe member 21 for attenuating exhaust noise component which is generated owing to insufficient noise reduction levels in the two exhaust systems. More specifically, sound pressure mode diagrams are obtained with respect to a plurality of resonant frequencies by using the four-terminal constants method. Then, a section (of the exhaust system) corresponding to the antinode of a sound pressure mode or wave system is sought from each sound pressure mode diagram. In the vicinity of this section (antinode), sound pressure is the maximum. By causing this section of one exhaust system to communicate with the corresponding section of the other exhaust system, sound pressure of exhaust gas emitted from the both exhaust systems is lowered thereby to lower noise level at the frequencies at which IL is insufficient, since the phase of the sound pressure mode in the first exhaust system 14 is reverse to that in the second exhaust system 15. In this case, since actually developed resonant frequencies can be guessed by simulating noise reduction characteristics, it is possible to set a suitable connecting position of the communicating pipe member 21 relative to a plurality of resonant frequencies.

Figure 5:
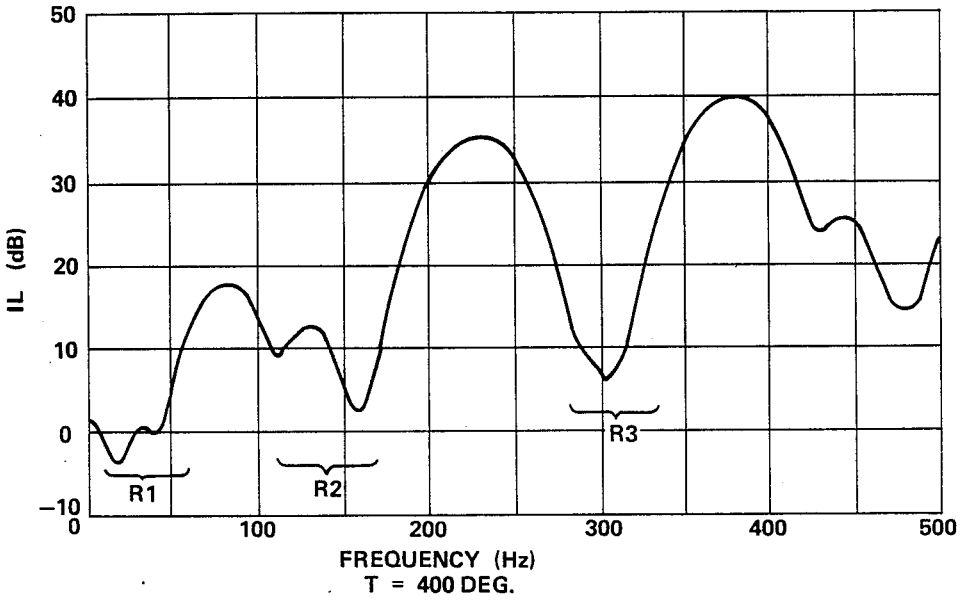
FIG. 5 is a graph of noise reduction characteristics obtained by simulation calculation in connection with the exhaust system of FIG. 2.
Figure 6:
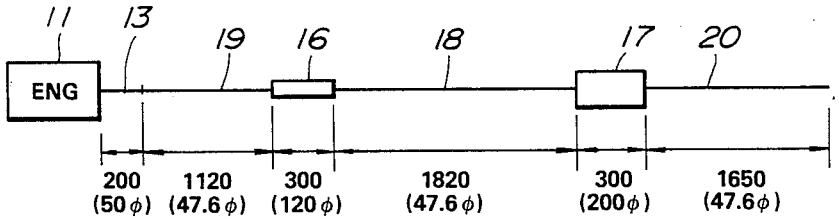
FIG. 6 is a diagrammatic view of a linear model of the exhaust system of FIG. 2, to be used for the simulation calculation of the noise reduction characteristics of FIG. 5.
Figure 7:
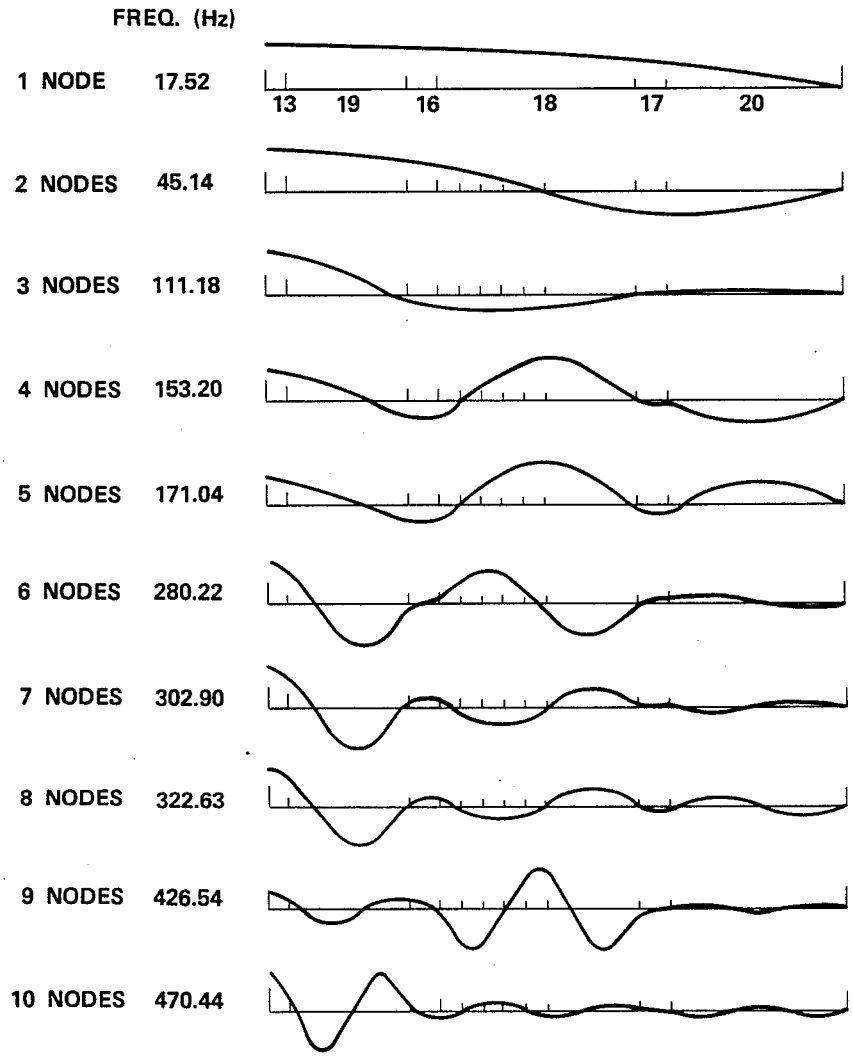
FIG. 7 is a graph showing sound pressure modes obtained by the simulation calculation.

FIG. 5 shows a noise reduction characteristics diagram which is obtained by the four-terminal constants method, upon linearly modeling each exhaust system 14, 15 of FIG. 2 as shown in FIG. 6. In FIG. 6, a numerical value within parentheses "( )" indicates the inner diameter of the pipe line. FIG. 7 shows sound pressure mode diagrams of resonance similar to FIG. 4, in which the numerals along the axis of abscissa of the diagram for a "one node" resonance designate the component parts in FIG. 2 and the connecting position (A to E in FIG. 2) of the communicating pipe member 21. These numerals in the one node resonance diagram are similar also in the diagrams of "two node" to "ten node" resonances though omitted for the purpose of simplicity of illustration.

It will be found from FIG. 5 that resonance is generated roughly in the vicinity of a frequency range R1 lower than 50 Hz, a frequency range R2 near about 150 Hz, and a frequency range R3 near about 300 Hz. Since IL is minimized in the vicinity of these frequency ranges, it is anticipated that noise level increases at these frequency ranges. In this case, if engine speed varies between 600 and 6000 rpm, the frequency of 1.5nd harmonics is within a range of from 15 to 150 Hz and therefore the resonance corresponds to the above-mentioned frequency ranges R1 and R2. Similarly, since the frequency of 4.5nd harmonics is within a range of from 45 to 450 Hz, the resonance corresponds to the above-mentioned frequency ranges R1, R2 and R3.

Referring to FIG. 7 includes resonant sound pressure mode diagrams of one node (17.52 Hz) to ten node (470.44 Hz) resonances which are produced with respect to the linear model of FIG. 6. In this case, the resonant frequency varies depending on temperature T within the exhaust system 14, 15. In this connection, the sound pressure mode diagrams of FIG. 7 are under a condition in which T=400° C. For example, on the assumption that the resonant frequency under the condition of T=400° C. is f, a resonant frequency $f_t$ in the case T varies by ΔT is given by Eq. (11).

$$f_t = f \cdot \sqrt{\frac{400 + \Delta T}{400}} \tag{11}$$

Accordingly, in practice, when the engine is operated at a low engine speed, the resonant frequency lowers owing to a lower temperature. However, since sound pressure mode itself depends on the length and the cross-sectional area of the pipe line of the exhaust system, it is not affected by temperature.

Now, if attention is paid to the mode diagrams of the two nodes resonance (45.14 Hz) as resonance approaching the frequency range R1 in which IL is lowered in the noise reduction characteristics, the connecting position A of the connecting positions A to E approaches the antinode of the sound pressure mode. Accordingly, it is anticipated that the resonant frequency is cancelled if the communicating pipe member 21 is located at the connecting position A. Concerning the four nodes resonance (153.2 Hz) and the five nodes resonance (171.04 Hz) approaching the frequency range R2, the connecting position E approaches the antinode of the sound pressure mode. Accordingly, if the connecting position of the communicating pipe member 21 is set at E, the resonant frequency is anticipated to be cancelled. Similarly, concerning the six, seven and eight nodes resonances approaching the frequency range R3, the connecting position of the communicating pipe member 21 is suitable at B and C.

By suitably setting the connecting position of the communicating pipe member 21 depending upon the above-discussed simulation results, actually measured values of sound pressure levels were obtained. The data of the graph of FIGS. 8 and 9 were obtained upon conducting measurement of sound pressure level at a position of 50 cm from the open end of the tube 20.

Figure 8:
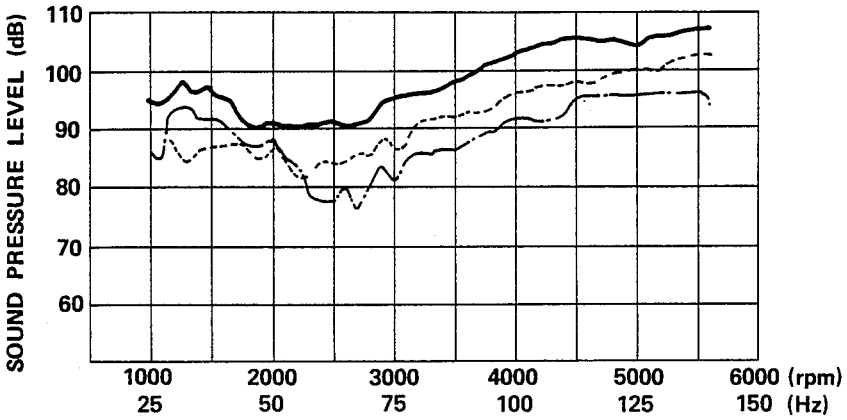
FIG. 8 is a graph showing noise reduction effect to 1.5nd harmonics in exhaust noise.

FIG. 8 shows data of measured noise level in the case of setting the connecting position of the communicating pipe member 21 upon paying attention to 1.5nd harmonics. The axis of abscissa in FIG. 8 indicates engine speed (rpm) and frequency of 1.5nd harmonics corresponding to the engine speed. In FIG. 8, a solid line represents a case in which the communicating pipe member 21 is not provided, while a broken line (dotted line) represents a case in which the connecting position of the communicating pipe member 21 is set at A depending upon the above-discussed simulation results. Now, paying attention to the vicinity of an engine speed of 1500 rpm (frequency corresponding to 1.5nd harmonics in the frequency range R1: 37.5 Hz), noise level in the case of providing the communicating pipe member 21 at the connecting position A is largely reduced about 10 dB as compared with a case in which no communicating pipe member is provided. In other words, cancellation of resonant frequency can be made by providing the communicating pipe member 21 for communicating the pipe lines of the first and second exhaust systems 14, 15. It will be understood that the measured values in FIG. 8 well coincide with predicted values by the simulation. A dot-dash-line in FIG. 8 represents a case in which the connecting position of the communicating pipe member 21 is set at E, anticipating cancellation of 1.5nd harmonics in the frequency range R2. In this case, by paying attention to the vicinity of an engine speed of 4500 rpm (corresponding to 112.5 Hz) corresponding to 1.5nd harmonics in the frequency range R2, cancellation effect of sound pressure level over 10 dB can be similarly obtained.

Figure 9:
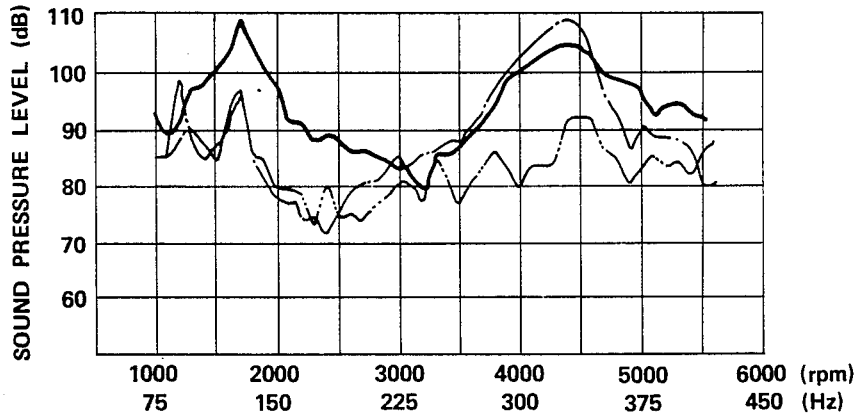
FIG. 9 is a graph showing noise reduction effect to 4.5nd harmonics in exhaust noise.

FIG. 9 shows noise levels measured upon paying attention to 4.5nd harmonics. In FIG. 9, a solid line represents a case in which no communicating pipe member is provided; a broken line (dot-dash-line) represents a case in which the communicating pipe member 21 is provided only at the connecting position E; and a dot-dot-dash line represents a case in which the communicating pipe members 21, 21 are provided respectively at the connecting positions B and E. As apparent from the data of FIG. 9, if the communicating pipe members 21, 21 are disposed respectively at the connecting positions B and E, noise reduction effect of more than 10 dB is obtained at a frequency near 1700 rpm (about 127.5 Hz) in the frequency range R2 and at a frequency near 4400 pm (about 330 Hz) in the frequency range R3, in coincidence with the result of simulation. If the communicating pipe member 21 is disposed only at the connecting position E, a sufficient reduction effect to the frequencies near the frequency range R2 can be obtained while providing no effect to the frequencies in the frequency range R3. This demonstrates that noise reduction of the communicating pipe member 21 is effective only for a particular resonance mode having an antinode near which the communicating pipe member 21 is positioned. In other words, cancellation effect cannot be obtained for resonant frequencies having a sound pressure mode antinode near which the connecting position of the communicating pipe member 21 does not lie. This means that cancellation of a plurality of resonance frequencies can be made by setting a plurality of suitable connecting positions of the communicating pipe members 21.

Thus, by setting the connecting position of the communicating pipe member 21 in the vicinity of the location of the antinode of the resonant sound pressure mode, a target resonance mode or frequency can be cancelled on the basis of the fact that sound pressure modes of the first and second exhaust systems 14, 15 are reverse in phase to each other. Accordingly, a sharp sound pressure level reduction can be attained in the vicinity of frequencies at which noise reduction characteristics are lowered owing to resonance, i.e., for $(1.5+3n)nd$ harmonics in engine revolution. As a result, the width of the range occupied with noise components is decreased thereby achieving lower noise level and avoiding uncomfortableness in an auditory sense.

Although only one muffler has been shown and described as being disposed in each of the exhaust systems 14, 15 in the above-mentioned embodiment, a noise reduction technique will be made hereinafter on a second embodiment of the exhaust system of the present invention in which two mufflers are disposed in each of the exhaust systems 14, 15. This is in conformity with the usually used exhaust systems.

Figure 10:
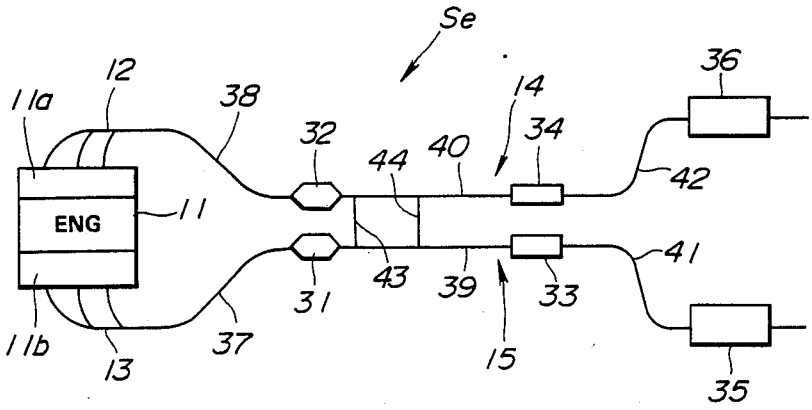
FIG. 10 is a diagrammatic view of a second embodiment of the exhaust system according to the present invention.
Figure 11:
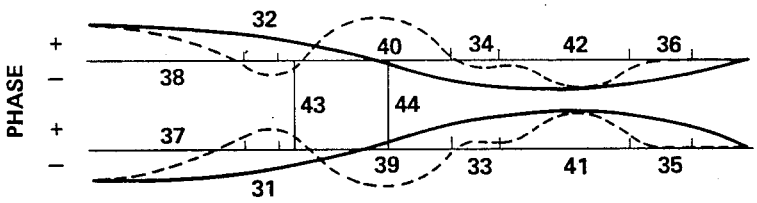
FIG. 11 is an explanatory view showing sound pressure modes obtained by simulation calculation.

FIG. 10 illustrates the second embodiment of the exhaust system Se of the present invention, which is similar to the first embodiment exhaust system in that the engine 11 is provided with the first and second exhaust systems 14, 15. Referring to FIG. 10, exhaust gas from each bank 11*a*, 11*b* of the engine 11 is gathered in the corresponding exhaust manifold 12, 13 and discharged through a catalytic converter 31, 32, a center muffler 33, 34 and a sub-muffler 35, 36 into ambient air. The exhaust manifold 12, 13 and the catalytic converter 31, 32 are connected by a tube 37, 38. The catalytic converter 31, 32 and the center muffler 33, 34 are connected by a tube 39, 40. The center muffler 33, 34 and the sub-muffler 35, 36 are connected by a tube 41, 42. The parallely arranged tubes 39, 40 are connected with each other by two communicating pipe members 43, 44 so that the tubes 39, 40 are in communication with each other. The exhaust system Se of FIG. 10 exhibits a sound pressure mode at a resonant frequency as shown in FIG. 11. The sound pressure mode is obtained by the above-mentioned four-terminal constants method in a manner similar to that in the first embodiment. It is to be noted where the sound pressure mode in FIG. 11 is a case where the communicating pipe members 43, 44 are not provided. The numerals in FIG. 11 correspond to the reference numerals in FIG. 10. It will be seen from FIG. 11, that the sound pressure modes in the first and second exhaust systems 14, 15 are reverse in phase to each other. In other words, at the corresponding position of the first and second exhaust systems 14, 15, the phase in the first exhaust system is positive while the phase of the second exhaust system is negative. Accordingly, the resonance indicated by solid lines are cancelled by providing the communicating pipe member 43, while the resonance indicated by broken lines are cancelled by providing the communicating pipe member 44.

Figure 12:
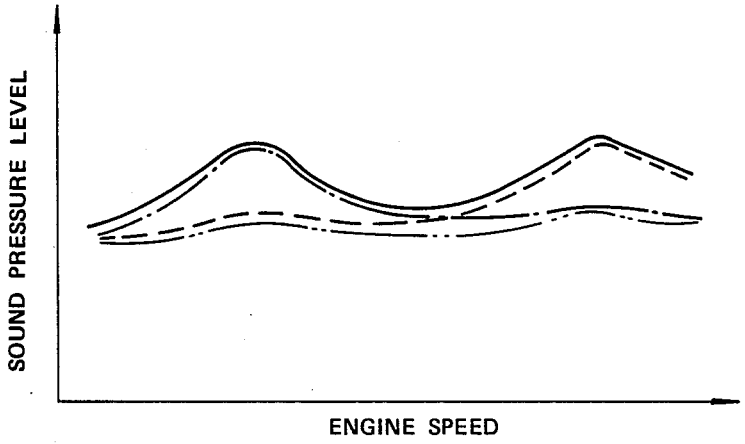
FIG. 12 is a graph showing noise reduction effect of the exhaust system of FIG. 10.

Such resonance cancellation effect is charted and shown in FIG. 12 in which a solid line indicates a case in which no communicating pipe member is provided; a broken line indicates a case in which only the communicating pipe member 43 is provided; a dot-dash line indicates a case in which only the communicating pipe member 44 is provided; and a dot-dot-dash line indicates a case in which both the communicating pipe members 43, 44 are provided. FIG. 12 demonstrates that the positions of the communicating pipe members 43, 44 are effective respectively for particular resonant frequencies, in which each of the positions corresponds to the vicinity of the antinode of resonant sound pressure modes in each exhaust system.

Thus, since the phases of resonant sound pressure modes of the two exhaust systems 14, 15 of the V-type six-cylinder engine are reverse to each other, the resonances can be cancelled by providing the communicating pipe members 43, 44 respectively in positions each in the vicinity of the antinode of the resonant sound pressure mode, thereby obtaining the same advantageous effect as in the first embodiment. Additionally, in this embodiment, noise reduction is accomplished by the center muffler 33, 34 and the sub-muffler 35, 36, and therefore noise level can be further reduced over the first embodiment.

Although the above-discussed first and second embodiment exhaust systems have been shown and described as being arranged so that the connecting positions of the communicating pipe member or members are set upon paying attention to noise frequency components lower than 500 Hz in which the sound pressure mode is relatively well in conformity with that of the simulation results of the four-terminal constants method, discussion will be made on a case in which noise components higher than 500 Hz are also similarly cancelled, in connection with a third embodiment of the exhaust system in accordance with the present invention.

Figure 13:
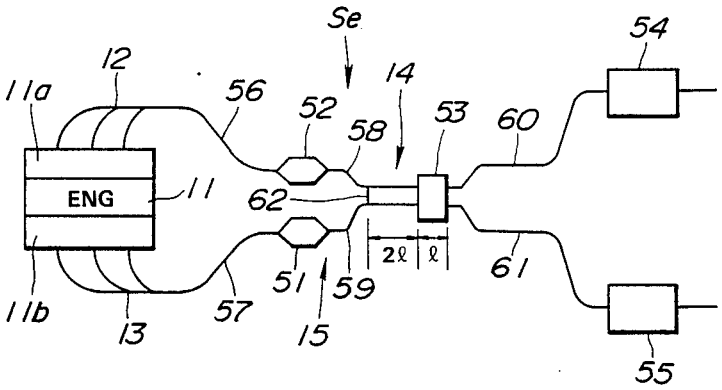
FIG. 13 is a diagrammatic view of a third embodiment of the exhaust system according to the present invention.
Figure 14:
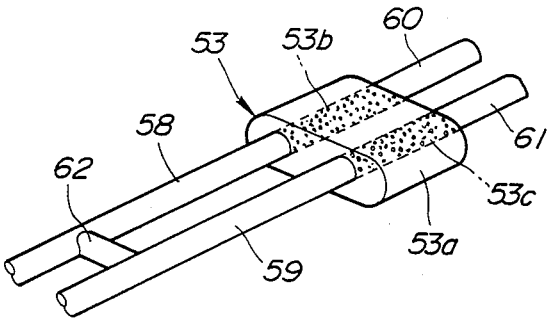
FIG. 14 is a perspective view of an essential part of the exhaust system of FIG. 13.

FIG. 13 and 14 illustrates the third embodiment of the exhaust system Se of the present invention, which is similar to the first embodiment exhaust system of FIG. 2 in that the engine 11 is provided with the first and second exhaust systems 14, 15. Referring to FIG. 13, exhaust gas from each engine bank 11*a*, 11*b* is gathered in the exhaust manifold 12, 13 and discharged through a catalytic converter 51, 52, a porous expansion type sound attenuation device 53 and a rear muffler 54, 55 to ambient air. As shown in FIG. 14, the porous expansion type sound attenuation device 53 includes a casing 53*a* defining therein a hollow chamber. Two porous or perforated pipes 53*b*, 53*c* are disposed within the casing 53*a*. The tube 58 and the tube 60 are connected through the porous pipe 53*b*. The tube 59 and the tube 61 are connected by the porous pipe 53*c*. Thus, the pipe line of the first exhaust system 14 and the pipe line of the second exhaust system 15 are in communication with each other through the sound attenuation device 53. Accordingly, the sound attenuation device 53 allows the first and second exhaust systems 14, 15 to acoustically communicate with each other and therefore serves as a kind of acoustic filter and also as the communicating pipe member. Additionally, the exhaust manifold 12, 13 and the catalytic converter 51, 52 are connected by a tube 56, 57. The catalytic converter 51, 52 and the sound attenuation device 53 are connected by the tube 58, 59.

The sound attenuation device 53 and the rear muffler 54, 55 are connected by the tube 60, 61. The tubes 58, 59 are in communication with each other by a communicating pipe member 62. The connecting position of the communicating pipe member 62 is separated 2l from the sound attenuation device 53 on the assumption that the length of the sound attenuation device 53 is l. The communication pipe member 62 functions to cancel resonant frequencies lower than 500 Hz similarly to that in the first and second embodiments, thereby omitting the detailed explanation thereof. This embodiment features cancellation of relatively high frequency components of exhaust noise under the action of the porous expansion chamber type sound attenuation device 53, which will be discussed hereinafter.

Figure 15:
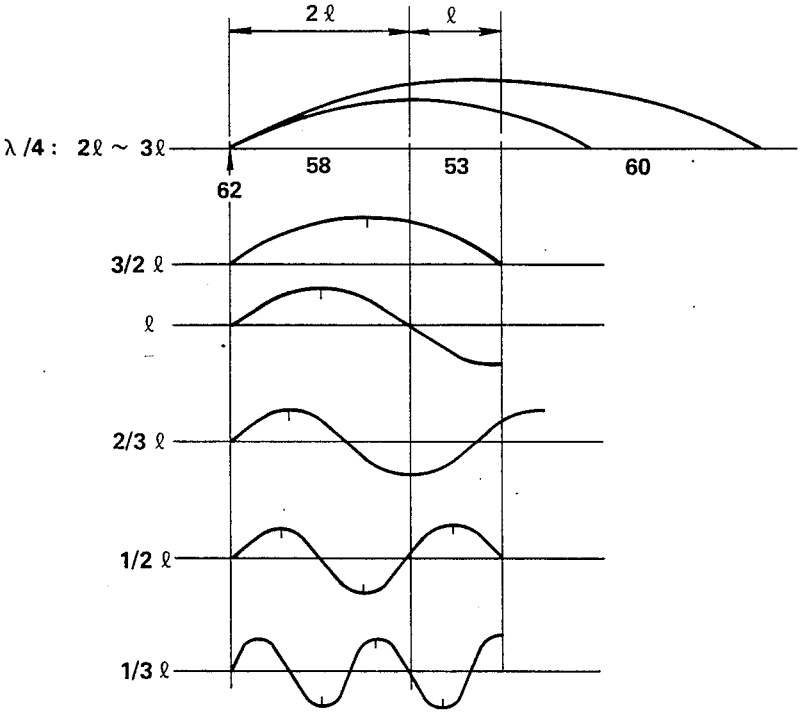
FIG. 15 is a graph of sound pressure modes for illustrating operation of the exhaust system of FIG. 13.

Concerning a plurality of frequency components within a high frequency region in which the wave length is short, it is practically difficult to cancel them by communicating the first and second exhaust systems 14, 15 at a position near the antinode of the resonant sound pressure mode because this is equivalent to infinitely increasing number of the connecting positions of the communicating pipe members. In view of this, paying attention to the fact that wave length becomes short as frequency becomes high, the distance of the sound attenuating device 53 from the communicating pipe member 62 is set to be 2l in the case wherein the length of the sound attenuation device 53 is l. In this case, sound pressure modes whose node is generated at the connecting position of the communicating pipe member 6 are as shown in FIG. 15. In FIG. 15, one-fourth of the wavelength (λ) of the resonant sound pressure mode is represented by using l. The numerals in FIG. 15 corresponding to the reference numerals in FIGS. 13 and 14. As mentioned above, since the node of the resonant sound pressure mode resides in the connecting position of the communicating pipe member 62, cancellation of the resonant frequency cannot be made by the communicating pipe member 62. However, high sound pressure sections corresponding to the antinode and the vicinity of the antinode of the resonant sound pressure mode are developed at the location of the sound attenuation device 53, so that resonant frequencies having opposite phases generated respectively in the first and second exhaust systems 14, 15 are composed in the sound attenuation device 53. As a result, the resonant frequencies are cancelled thereby to obtain a noise reduction effect of more than 10dB. While illustration is made up to a frequency in which λ/4 is ⅓l, it will be understood that secure cancellation can be made with regard to frequencies in which λ/4 is shorter than ⅓l because a plurality of antinodes are developed in the sound attenuation device 53. Thus, according to the present invention, cancellation of relatively high resonant frequencies can be achieved in addition to cancellation of relatively low resonant frequencies as achieved also in the first and second embodiments. Although it is considered that the antinode positions of the resonant sound pressure mode varies with change in exhaust gas, the above-discussed resonant frequencies cancellation effect can be likewise obtained thereby to lower noise level of the exhaust system Se because the first and second exhaust systems 14, 15 are in communication with each other through a broad range having the length l.

While the principle of the present invention has been shown and described as being applied to the exhaust system of the V-type six-cylinder engine, it will be appreciated that the principle is applicable to the exhaust system of other type of engines whose exhaust system consists of a plurality of exhaust systems which respectively develop opposite phase resonant sound pressure modes. In this regard, an exhaust system to which the principle of the present invention is applied may be of a V-type twelve-cylinder engine.

What is claimed is:

1. An exhaust system for a multi-cylinder engine, comprising:

means for dividing exhaust ports of the engine into first and second groups;

first and second exhaust systems each of which includes a catalytic converter, a muffler and a first tube for fluidly connecting said catalytic converter with said muffler, said catalytic converter of said first exhaust system communicating with said first group exhaust ports, said catalytic converter of said second exhaust system communicating with said second group exhaust ports:

at least one communicating pipe member for communicating said first tubes of said first and second exhaust systems, said communicating pipe member having a first end connected to said first exhaust system first tube at a first predetermined position between said catalytic converter and said muffler, and a second end connected to said second exhaust system first tube at a second predetermined position corresponding to said first predetermined position.

2. An exhaust system as claimed in claim 1, wherein said first predetermined position corresponds to the position of the antinode of the resonant sound pressure mode in said first exhaust system, and said second predetermined position corresponds tot he position of the antinode of the resonant sound pressure mode in said second exhaust system.

3. An exhaust system as claimed in claim 1, wherein the resonant sound pressure mode in said first exhaust system is reverse in phase relative to the resonant sound pressure mode in said second exhaust system.

4. An exhaust system as claimed in claim 1, wherein said at least one communicating pipe member includes first and second pipe members for communicating said first exhaust system first tube and said second exhaust system first tube, said first communicating pipe member having a first end connected to said first exhaust system first tube at a first predetermined position between said catalytic converter and said muffler, and a second end connected to said second exhaust system first tube at a second predetermined position corresponding to said first position, said second communicating pipe member having a first end connected to said first exhaust system first pipe at a third position between said catalytic converter and said muffler, and a second end connected to said second exhaust system first pipe at a fourth position corresponding to said third position.

5. An exhaust system as claimed in claim 4, wherein said first and third predetermined positions correspond respectively to positions of antinodes of first and second resonant sound pressure modes in said first exhaust system, and said second and fourth predetermined positions correspond respectively to positions of antinodes of third and fourth resonant sound pressure modes in said second exhaust system, wherein said first and third resonant sound pressure modes are reverse in phase to each other, and said second and fourth resonant sound pressure modes are reverse in phase to each other.

6. An exhaust system as claimed in claim 1, further comprising means defining a chamber in which said first tubes of said first and second exhaust systems are in communication with each other, said chamber defining means being located between said catalytic converter and said muffler in said first and second exhaust systems.

7. An exhaust system as claimed in claim 6, wherein said communicating pipe member is disposed upstream of said chamber defining means.

8. An exhaust system as claimed in claim 6, wherein said chamber defining means includes a casing defining therein a chamber, and first and second porous pipes disposed in said chamber, insides of said first and second porous pipes communicating with each other, said first porous pipe forming part of said first tube of said first exhaust system, said second porous pipe forming part of said first tube of said second exhaust system.

9. An exhaust system as claimed in claim 1, wherein said exhaust ports dividing means includes first and second exhaust manifolds communicating respectively with said first group exhaust ports and second group exhaust ports.

10. An exhaust system as claimed in claim 9, wherein each of said first and second exhaust systems includes a second tube by which said catalytic converter is fluidly connected to said exhaust manifold.

* * * * *